United States Patent [19]

McNair

[11] 3,942,520

[45] Mar. 9, 1976

[54] FOOT MASSAGER

[75] Inventor: Samuel L. McNair, Overland Park, Kans.

[73] Assignee: Dazey Products Co., Kansas City, Mo.

[22] Filed: Mar. 27, 1975

[21] Appl. No.: 562,442

[52] U.S. Cl. ..... 128/24.1; 128/25 B; 128/36

[51] Int. Cl.[2] ..... A61H 29/00

[58] Field of Search ..... 128/25 B, 33–36, 128/41, 24.1, 24.2

[56] References Cited

UNITED STATES PATENTS

| | | | |
|---|---|---|---|
| 2,235,158 | 3/1941 | Krenzke | 128/33 |
| 2,566,484 | 9/1951 | Coury | 128/25 B |
| 2,894,505 | 7/1959 | Manausa | 128/33 |
| 3,043,294 | 7/1962 | Neff | 128/25 B |
| 3,830,232 | 8/1974 | McNair | 128/25 B |
| 3,841,320 | 10/1974 | Brown | 128/33 |

*Primary Examiner*—Lawrence W. Trapp

*Attorney, Agent, or Firm*—Lowe, Kokjer, Kircher, Wharton & Bowman

[57] ABSTRACT

A foot massager has a hollow casing that includes a top panel for accommodating the feet of the user. A vibrator motor is mounted against the underside of the top panel by a bent metal strap having opposite ends that are connected to bosses projecting from the top panel. Lugs extending from the top panel prevent lateral movement of the motor. An electrically restive heating sheet is adhesively attached to the top panel and is further secured thereto by a pair of metal bands and a pair of clips.

6 Claims, 3 Drawing Figures

FOOT MASSAGER

BACKGROUND AND SUMMARY OF THE INVENTION

This invention relates to foot massaging devices that apply a vibration force to the feet of the user.

Although vibrational foot massaging devices have been used for some time, they have not been wholly satisfactory. The motors of existing devices are typically mounted for at least some degree of movement relative to the casing on which the user stands, and the vibrational force of the motor is therefore damped somewhat and not fully imparted to the casing. The motor is also susceptible to being eventually jarred loose from the casing as a result of the vigorous vibrational forces that are repeatedly exerted. Furthermore, even though the advantages of applying heat along with the vibration massage have been recognized, the heating elements have not been attached in a firm enough manner to withstand the vibration of the device.

It is an object of the present invention to provide an improved foot massager which utilizes the energy of the vibrator motor more effectively than existing devices.

Another object of the invention is to provide a foot massager in which the vibrator motor is securely mounted to the casing.

An additional object of the invention is to provide a foot massager having improved heating means which applies heat to the feet of the user in a uniform manner.

A further object of the invention is to provide a foot massager having a heating strip that is attached to the casing firmly enough to withstand the vibrational forces.

Still another object of the invention is to provide a foot massager of the character described that is simple, durable, economical and lightweight.

Other and further objects of this invention, together with the features of novelty appurtenant thereto, will appear in the course of the following description.

DETAILED DESCRIPTION OF THE INVENTION

In the accompanying drawing which forms a part of the specification and is to be read in conjunction therewith, and in which like reference numerals are employed to indicate like parts in the various views.

Figure 1:
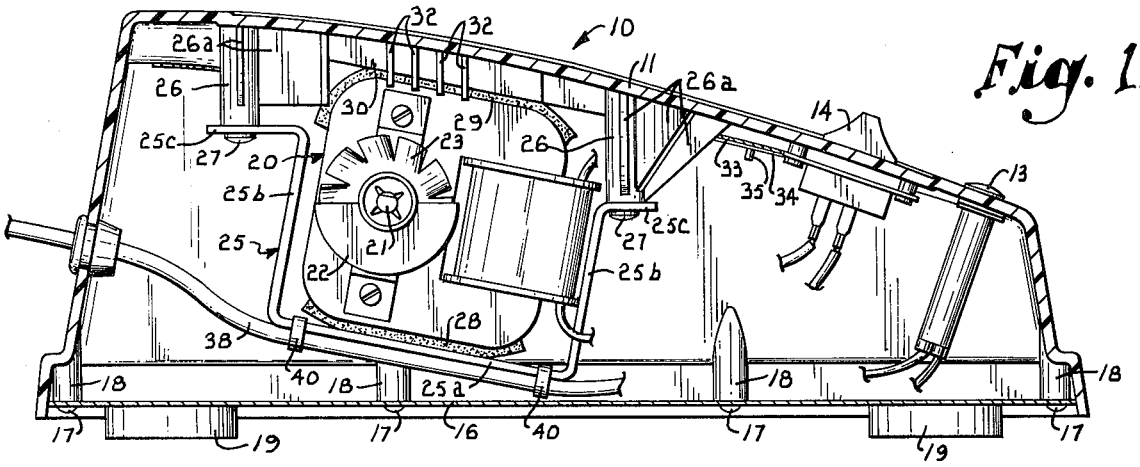
FIG. 1 is a side elevational view in crosssection illustrating a foot massager constructed according to the invention.

Referring now to the drawing in detail, a hollow casing which is preferably molded of a good quality plastic is generally designated by numeral 10. The casing includes an integral top panel 11 which provides the usual two foot receiving areas (not shown) that are generally contoured in accordance with the sole of the human foot. A console or divider (not shown) extends the length of panel 11 between the foot receiving areas. An indicator lamp 13 and a pair of slidable switches 14 and 15 are mounted on this console.

Casing 10 has an open bottom which is covered by a thin closure plate 16. Plate 16 is preferably metallic and is secured to casing 10 by a plurality of screws 17 which are received in corresponding bosses 18 molded into and projecting downwardly from the lower edge of the casing. Four support pads 19 which are preferably rubber or a similar material are secured to the bottom of plate 16 near the corners thereof.

Turning now to the interior of the casing, a vibrator motor 20 is mounted against the underside of top panel 11. Motor 20 is a conventional electric motor which drives a rotary output shaft 21. Eccentric portions 22 are mounted on the opposite ends of shaft 21 and serve to unbalance the shaft. A fan 23 is also carried on shaft 21, and the fan operates to pass cooling air over the motor when shaft 21 is rotating.

Motor 20 is mounted against top panel 11 by an elongate bracket in the form of a thin metal strap 25. Strap 25 has a straight central portion **25*a* which bears against the underside of motor 20, a pair of generally parallel legs 25*b* extending upwardly from the ends of portion 25*a*, and oppositely turned flanges 25*c* on the upper ends of the legs which are secured to generally cylindrical bosses 26 by screws 27. Bosses 26 are integral with the underside of top panel 11 and project generally downwardly therefrom at spaced locations. Each boss 26 has a plurality of triangular gusset ribs 26*a* which reinforce the bosses with respect to the top panel of the casing. Ribs 26*a* extend radially from spaced locations on the sides of bosses 26 and join integrally to the bottom of panel 11** to add rigidity to the bosses.

As best shown in FIG. 1, a foam rubber pad 28 is interposed tightly between the bottom side of motor 20 and the straight central portion **25*a* of strap 25. Another foam rubber pad 29 is tightly interposed between the top side of motor 20 and a large rectangular boss 30 which is integral with the underside of panel 11 and projects downwardly therefrom. Accordingly, strap 25 securely mounts motor 20 tightly between its straight intermediate portion 25a and the boss 30 so that the vibrational force is fully imparted to top panel 11,** as will become clear.

Four lugs 32 project downwardly from top panel 11 at locations adjacent to each of the opposite sides of boss 30. Lugs 32 extend somewhat below the bottom surface of boss 30 and thus engage the opposite sides of motor 20 to restrain the motor against any lateral movement. Each lug 32 is perpendicular to the side of the motor which it engages.

Figure 2:
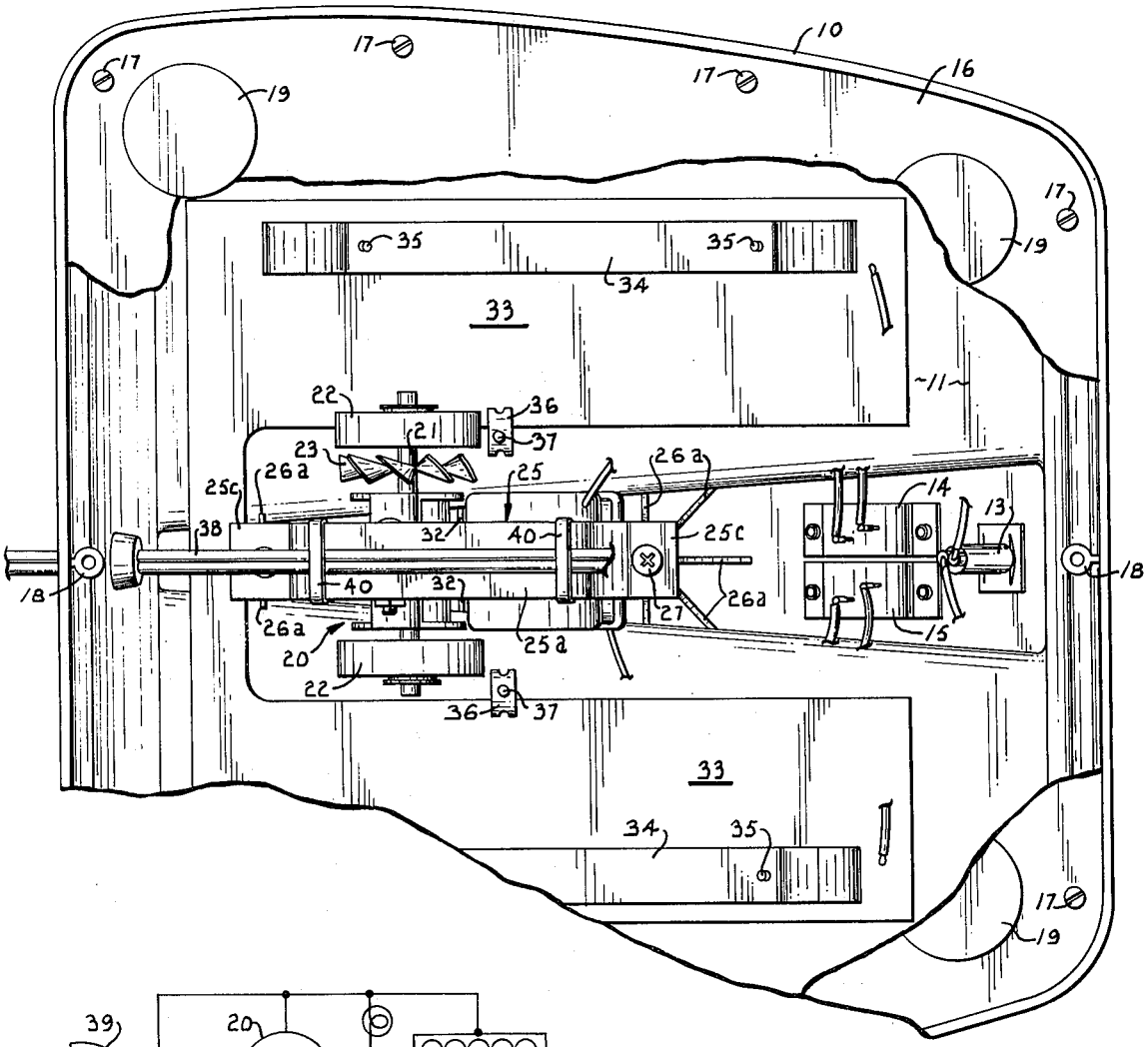
FIG. 2 is a bottom plan view of the foot massager shown in FIG. 1, with the bottom closure plate partially broken away to illustrate the internal structure.

A heating element in the form of electrically resistive members incorporated in a thin fabric sheet 33 is secured to the underside of panel 11, as best illustrated in FIG. 2. Sheet 33 has two halves interconnected at their forward ends by a thin strip. The area of the sheet 33 is substantially equal to the area of the soles of the feet applied to the top of panel 11. A suitable adhesive adheres sheet 33 directly to panel 11. Also, a pair of thin, elongate metal bands 34 assist in attaching sheet 33 to panel 11. Bands 34 each have a pair of apertures which are passed over small bosses 35 that project downwardly from top panel 11 at locations near the opposite outer edges of sheet 33. Bands 34 are firmly attached to bosses 35 and bear tightly against the underside of sheet 33 to assist in firmly securing the sheet to the top panel.

In addition, a pair of metal clips 36 are provided with apertures which are passed over respective bosses 37 that project downwardly from top panel 11 adjacently inwardly of each half of sheet 33. Clips 36 are firmly attached to bosses 37 with one end of each clip bearing tightly against the underside of one of the halves of sheet 33 at the inward edge thereof to firmly secure these edges against the top panel.

Figure 3:
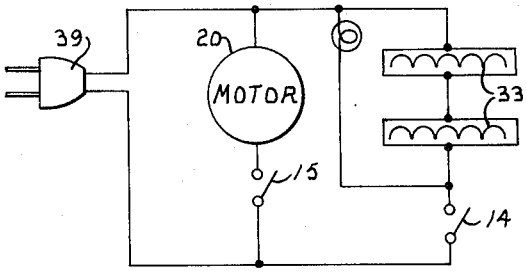
FIG. 3 is a schematic diagram showing the electrical circuitry of the foot massager.

An electric cord 38 has a plug 39 (FIG. 3) on its end for connection to an appropriate wall outlet. Cord 38 enters the forward end of casing 11 and is clamped to the intermediate portion 25a of strap 25 by a pair of clamps 40. Cord 38 supplies electric current to motor 20 and heating sheet 33 when switches 15 and 14, respectively are closed.

In operation, after plug 39 has been connected to a wall outlet, the user stands upon top panel 11 and closes switch 15 with his foot in order to energize motor 20. The rotation of shaft 21 results in substantial vibration due to the unbalancing effect caused by eccentrics 22. The full vibrational force is transmitted either directly to top panel 11 through boss 30, or initially to strap 25 and then to top panel 11 through bosses 26. Consequently, the vibration of the motor is not damped and the entire output energy of the motor is imparted to panel 11, which therefore vibrates in a pronounced manner.

If the user desires heat along with the vibrational massage, switch 14 can be closed by the foot to close the circuit to the heating sheet 33 which will then distribute heat uniformly to the soles of the feet. It should be apparent that the unit is operable to produce a massaging effect alone, heating alone, or both a massage and heating, depending upon the positions of switches 14 and 15.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A foot massager comprising a casing having a top panel adapted to support a pair of feet;

a vibrator assembly located within said casing and including a motor operable to effect vibration of said top panel;

a rigid, elongate strap for mounting said motor against said top panel, said strap having opposite ends spaced apart from one another and an intermediate portion adapted to engage the bottom side of said motor;

means for securing the opposite ends of said strap to said top panel with the top side of said motor bearing tightly against said top panel and said intermediate strap portion bearing tightly against the bottom side of said motor; and lug means extending from said top panel for retaining said motor against lateral movement.

2. A combination as set forth in claim 1, including a pair of bosses projecting downwardly from said top panel and spaced apart from one another a distance substantially equal to the distance between said opposite strap ends, said securing means comprising means for attaching the opposite strap ends to the respective bosses.

3. A combination as set forth in claim 2, including a plurality of ribs interconnecting said top panel and said bosses to reinforce the latter.

4. A combination as set forth in claim 1, wherein said lug means comprises a plurality of lugs extending from said top panel at locations to engage said motor on opposite sides thereof.

5. A combination as set forth in claim 1, including:

an electrically resistive heating sheet presenting an area substantially equal to the area of the soles of the feet and operable to emit heat;

adhesive means for attaching said heating sheet to the underside of said top panel in substantially continuous contact therewith; and a pair of strap members secured to said top panel and bearing against the bottom surface of said heating sheet to cooperate with said adhesive means in retaining the heating sheet against said top panel.

6. A combination as set forth in claim 5, including a pair of clips secured to said top panel and engaging said heating sheet at locations offset from said strap members, said clips cooperating with said adhesive means and strap members to retain said heating sheet against said top panel.

* * * * *